US009586398B2

(12) United States Patent
Kato et al.

(10) Patent No.: US 9,586,398 B2
(45) Date of Patent: Mar. 7, 2017

(54) INK JET RECORDING APPARATUS

(71) Applicant: CANON KABUSHIKI KAISHA, Tokyo (JP)

(72) Inventors: Masataka Kato, Yokohama (JP); Masaya Uetsuki, Yokohama (JP); Toshimitsu Danzuka, Tokyo (JP); Kazuo Suzuki, Yokohama (JP); Tsuyoshi Ibe, Yokohama (JP); Shin Genta, Yokohama (JP); Asako Tomida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/073,443

(22) Filed: Mar. 17, 2016

(65) Prior Publication Data

US 2016/0271942 A1 Sep. 22, 2016

(30) Foreign Application Priority Data

Mar. 20, 2015 (JP) ..... 2015-057752

(51) Int. Cl.
*B41J 2/045* (2006.01)
*B41J 29/393* (2006.01)
*B41J 2/175* (2006.01)

(52) U.S. Cl.
CPC ..... *B41J 2/04573* (2013.01); *B41J 2/04586* (2013.01); *B41J 2/17566* (2013.01)

(58) Field of Classification Search
CPC .... B41J 2/04573; B41J 2/04586; B41J 2/175; B41J 2/17509; B41J 2/1752; B41J 29/393
See application file for complete search history.

(56) References Cited

U.S. PATENT DOCUMENTS 6,435,650 B1 * 8/2002 Nishioka ..... B41J 29/54 347/37
6,530,654 B2 * 3/2003 Kitabatake ..... B41J 2/17503 347/86

FOREIGN PATENT DOCUMENTS

JP 2002-326347 A 11/2002
JP 2004-314505 A 11/2004
JP 2004-358668 A 12/2004

* cited by examiner

*Primary Examiner* — Anh T. N. Vo
(74) *Attorney, Agent, or Firm* — Canon USA, Inc. I.P. Division

(57) ABSTRACT

An ink jet recording apparatus is capable of suppressing an increase of waste ink while solving an increase in density of ink within a supply tube. An ink jet recording apparatus according to the present invention includes a recording head configured to discharge ink, a tank configured to store ink, a supply tube configured to supply ink to the recording head from the tank, a discharge unit configured to execute a discharge operation for discharging ink within the supply tuber a control unit configured to make the discharge unit execute a discharge operation when an elapsed time from a previous discharge operation is greater than a predetermined time, and a changing unit configured to change at least any one of the elapsed time or the predetermined time based on an ink consumption amount consumed through the recording head after the previous discharge operation.

12 Claims, 18 Drawing Sheets

FIG. 10B

| NUMBER OF REGIONS | 1～25 | 26～50 | 51～75 | 75～100 |
|---|---|---|---|---|
| DRIVING TIME OF SUCTION PUMP DRIVING OPERATION A | 25s | 50s | 75s | 100s |

FIG. 11

| DRIVING TIME OF SUCTION PUMP DRIVING OPERATION A | 25s | 50s | 75s | 100s |
|---|---|---|---|---|
| UPDATED TIMER VALUE | $T_1 \sim T_{25}=0$<br>$T_n=T_{n-25}$ (n=26～100) | $T_1 \sim T_{50}=0$<br>$T_n=T_{n-50}$ (n=51～100) | $T_1 \sim T_{75}=0$<br>$T_n=T_{n-75}$ (n=76～100) | $T_1 \sim T_{100}=0$ |

INK JET RECORDING APPARATUS

BACKGROUND OF THE INVENTION

Field of the Invention

The present invention relates to a recording apparatus employing an ink jet system.

Description of the Related Art

Japanese Patent Application Laid-Open. No. 2002-326347 discusses a method for discharging ink the density of which is increased in a recording head, to the outside by executing recovery operations such as a suction operation and an auxiliary discharge operation. According to the above method, because the recovery operation is executed at a predetermined time, degradation of image quality caused by an increase in density of ink can be prevented.

In recent years, an ink jet recording apparatus has been employed in order to record an image on a large-size recording sheet (recording medium). A large-volume ink tank may be used because a large volume of ink is consumed in order to record an image on a large-size recording medium. The large-volume ink tank is fixed to a predetermined position of a recording apparatus main body since it may be difficult to mount the large-volume ink tank on a carriage. Then, ink is supplied to a recording head from the ink tank through a supply tube. In a case where a recording apparatus can record an image on a larger-size recording medium such as an A1 size sheet or an A0 size sheet, the supply tube has a long length because a scanning distance of the carriage is increased.

According to the method described in Japanese Patent Application Laid-Open No. 2002-326347, in a configuration using the above-described supply tube, because the ink within the supply tube has to be discharged at a predetermined time, an amount of waste ink is increased if the supply tube is longer in length.

On the other hand, in a case where the ink is consumed by a recording operation before a predetermined time has elapsed, new ink is supplied to the supply tube from the ink tank according to the ink consumption amount, and thus an increase in density of the ink within the supply tube is moderated. Therefore, even after the above-described predetermined time has elapsed, there may be a case where density of the ink within the supply tube has not yet been increased to an extent that the discharge operation is necessary. In the above-described method, because the ink within the supply tube is also discharged under the above condition, there is a risk in which waste ink is increased more than necessary.

SUMMARY OF THE INVENTION

According to an aspect of the present invention, an ink jet recording apparatus is capable of suppressing an increase of waste ink while solving an increase in density of ink within a supply tube.

According to another aspect of the present invention, an ink jet recording apparatus includes a recording head configured to discharge ink, a tank configured to store ink to be supplied to the recording head, a supply tube configured to supply ink to the recording head from the tank, a discharge unit configured to execute a discharge operation for discharging ink within the supply tube, a control unit configured to make the discharge unit execute a discharge operation when an elapsed time from a previous discharge operation is greater than a predetermined time, and a changing unit configured to change at least any one of the elapsed time or the predetermined time based on an ink consumption amount consumed through the recording head after the previous discharge operation.

Further features of the present invention will become apparent from the following description of exemplary embodiments with reference to the attached drawings.

BRIEF DESCRIPTION OF THE DRAWINGS

FIG. 10B is a table illustrating settings of a suction time of a pump.

FIG. 11 is a table illustrating an update method of a timer value according to the third exemplary embodiment of the present invention.

DESCRIPTION OF THE EMBODIMENTS

Hereinafter, an exemplary embodiment of the present invention will be described in detail with reference to the appended drawings.

Figure 1:
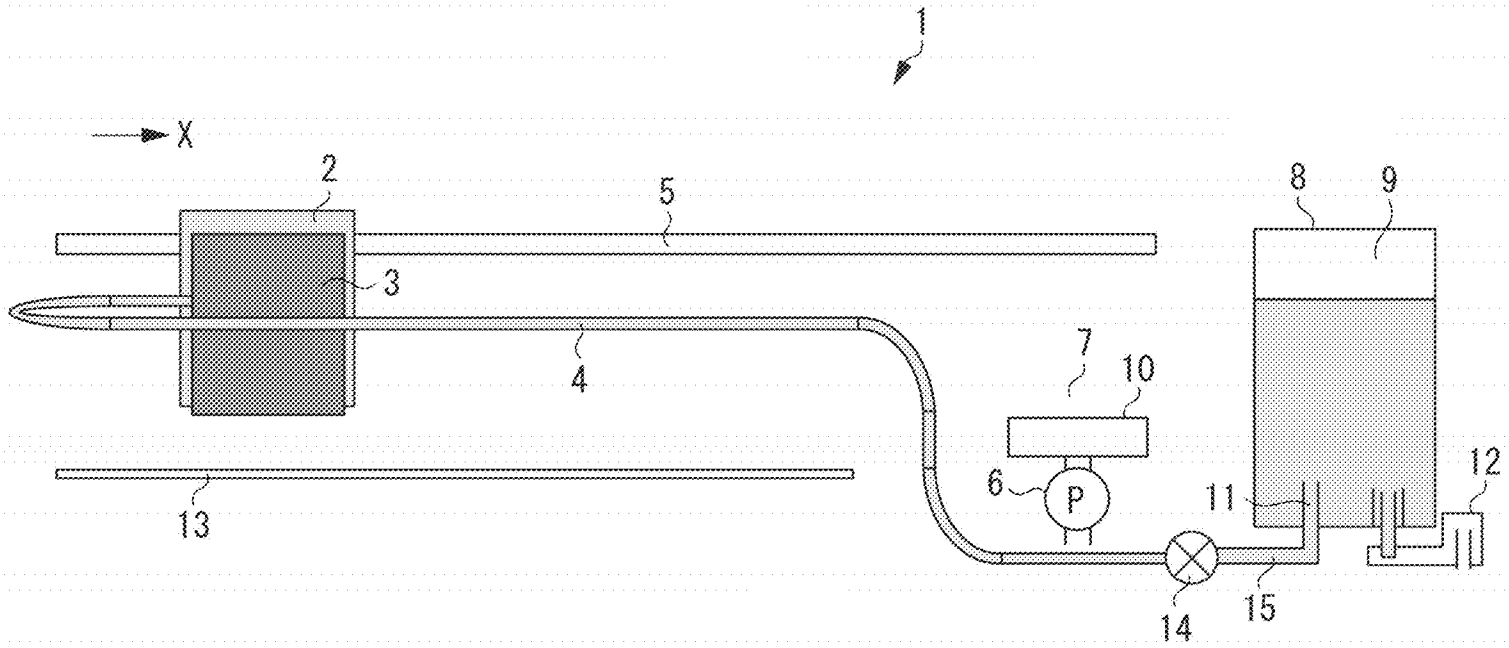
FIG. 1 is a schematic diagram illustrating an ink jet recording apparatus according to an exemplary embodiment of the present invention.

FIG. 1 is a schematic diagram illustrating an ink jet recording apparatus according to an exemplary embodiment of the present invention. A recording apparatus main body 1 is provided with various mechanism portions including a conveyance unit (not illustrated) of a recording medium 13. An ink jet recording apparatus according to the present exemplary embodiment is a serial type ink jet recording apparatus. The serial type ink jet recording apparatus records an image by moving a recording head 3 in a direction intersecting with a conveyance direction of the recording medium 13 (i.e., X direction) while intermittently conveying the recording medium 13 in a discharge direction of a platen (not illustrated) (i.e., Y direction) through the conveyance unit. Further, a size of the recording apparatus main body 1 is increased in the X direction so that an image can be recorded on a relatively large-size recording medium such as an A1 size sheet.

The recording head 3 is an ink jet recording head capable of discharging the ink supplied thereto through a plurality of discharge ports. The recording head 3 is detachably mounted on carriage 2. The carriage 2 reciprocally moves in the X direction together with the recording head 3. Specifically, the carriage 2 is supported to be capable of moving along a guide shaft 5 disposed in the X direction, and fixed to an endless belt (not illustrated) that moves substantially parallel to the guide shaft 5. The endless belt is reciprocally moved by a driving force of a carriage motor (CR motor), so as to make the carriage 2 reciprocally move in the X direction. A supply tube 4 is used as an ink flow channel. The supply tube 4 is formed of an elastic material. The supply tube 4 is connected to an ink supply system 8 via an openable-closable supply valve 14 (opening-closing valve). The supply tube 4 can supply ink to the recording head 3 even if the carriage 2 is moving in the X direction. The supply tube 4 is disposed to have a section that is substantially parallel in moving direction of the carriage 2. In addition, an arrangement of the supply tube 4 illustrated in FIG. 1 is merely an example.

The ink supply system 8 is fixed at a predetermined position of the recording apparatus main body 1. The ink supply system 8 is configured of an ink tank 9 (tank), a hollow tube 11, a buffer chamber 12, and a flow channel unit 15. The ink tank 9 is detachably mounted on the recording apparatus main body 1. The ink tank 9 stores ink that is to be supplied to the recording head 3. Further, the ink tank 9 is connected to the flow channel unit 15 disposed on the lower side of the ink tank 9 through the hollow tube 11. The flow channel unit 15 is formed by molding. The flow channel unit 15 is connected to the supply tube 4 through the supply valve 14. The ink tank 9 is connected to the flow channel unit 15 while being connected to and communicated with the buffer chamber 12 through a narrow tube. The connecting position thereof is located on the lower side of the ink tank 9. A communication tube communicating with an atmosphere is formed on the buffer chamber 12 in order to release the atmosphere. With this configuration, a balance between the inner pressure of the ink tank 9 and the atmospheric pressure can be maintained. In addition, the narrow tube for connecting the buffer chamber 12 and the ink tank 9 constitutes a flow channel that is narrow enough to minimize evaporation of ink within the ink tank 9.

A recovery processing device 7 includes a suction cap 10 that contacts the recording head 3 to cover the discharge ports, a suction pump 6 that sucks ink from the discharge ports via the suction cap 10, and an atmosphere valve (not illustrated) that switches a sealed state of an inner portion of the suction cap 10. The ink can be sucked from the recording head 3 if the suction pump 6 is driven while the atmosphere valve is closed in a state where the discharge ports are covered by the suction cap 10. The sucked ink is discharged to a waste ink tank (not illustrated). Further, the recovery processing device 7 includes a wiping mechanism (not illustrated) for wiping a face of the recording head 3.

Figure 2:
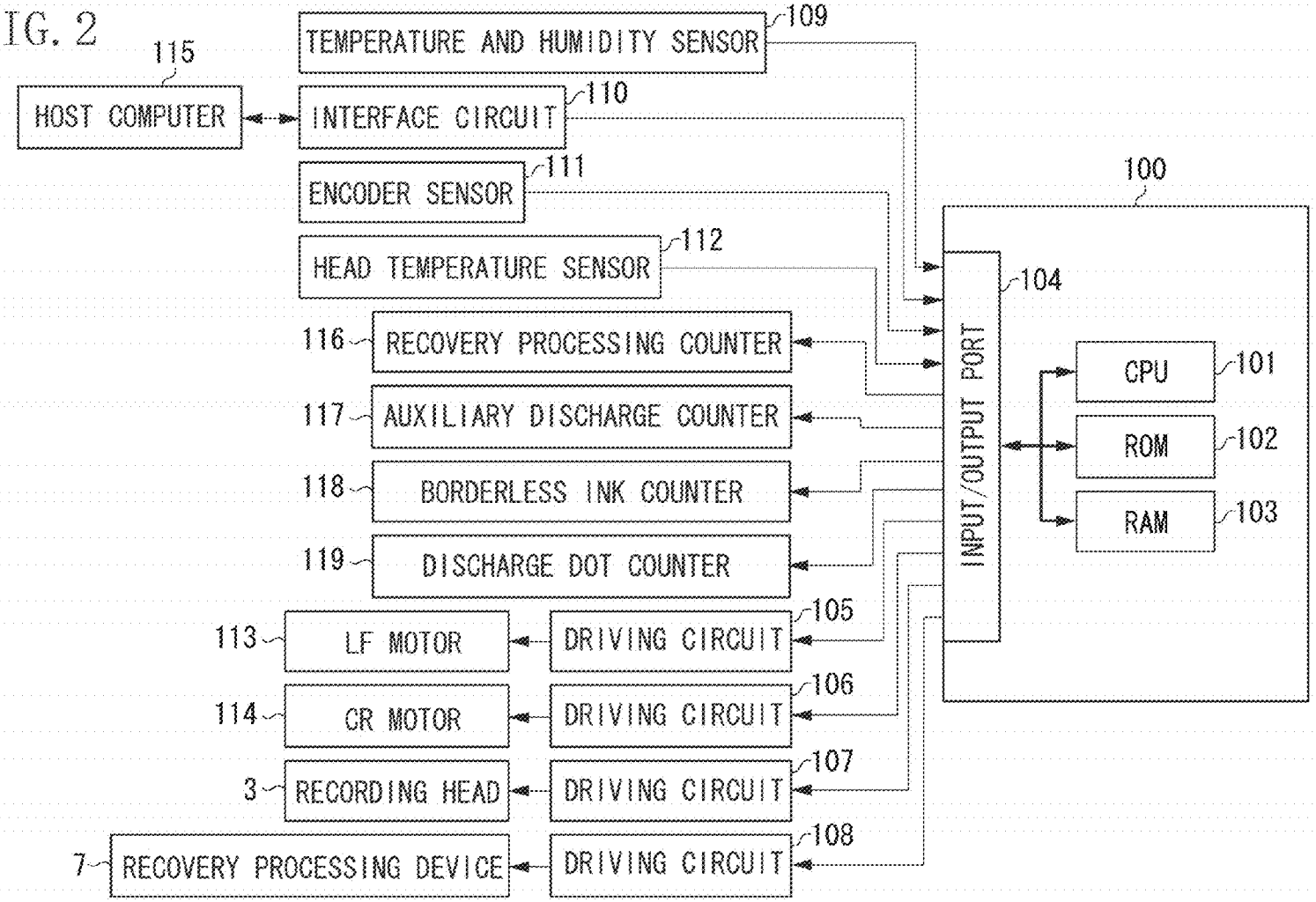
FIG. 2 is a block diagram illustrating a configuration of a control unit of an ink jet recording apparatus according to an exemplary embodiment of the present invention.

FIG. 2 is a block diagram illustrating a configuration of a control portion (control unit) of the ink jet recording apparatus according to the present exemplary embodiment. The control unit is configured of a main control portion 100. The main control portion 100 includes a central processing unit (CPU) 101 for executing processing operations such as calculation, control, determination, and setting, and a read only memory (ROM) 102 for storing a control program executed by the CPU 101. Further, the main control portion 100 includes a random access memory (RAM) 103 and an input/output port 104. The RAM 103 is used as a buffer that stores binary recording data for representing discharge or non-discharge of ink, or as a work area in which processing is executed by the CPU 101. Driving circuits 105, 106, 107, and 108 of a conveyance motor (line feed (LF) motor) 113 of the conveyance unit, a carriage (CR) motor 114, the recording head 3, and the recovery processing device 7 are connected to the input/output port 104. Further, various sensors such as a head temperature sensor 112 for detecting a temperature of the recording head 3, an encoder sensor 111 fixed to the carriage 2, and a temperature and humidity sensor 109 for detecting a temperature and a humidity of an operating environment of the recording apparatus main body 1 are connected to the input/output port 104. Further, the main control portion 100 is connected to a host computer 115 via an interface circuit 110. A recovery processing counter 116 counts an amount of ink in a case where the recovery processing device 7 forcibly discharges the ink from the recording head 3. Further, an auxiliary discharge counter 117 counts a number of auxiliary discharges executed before recording is started or ended, or when the recording is being executed. Then, a borderless ink counter 118 counts the ink discharged to a region outside of a recording medium in a case where borderless recording is executed. Further, a discharge dot counter 119 counts the ink discharged in a recording period.

Next, description of a recording operation executed by the ink jet recording apparatus configured as described above will be given. The recording apparatus receives recording data from the host computer 115 via the interface circuit 110 and loads the recording data into the RAM 103. Then, when a recording operation is instructed, the recording apparatus conveys a recording medium to a position facing the recording head 3 through the conveyance unit (not illustrated). At this time, the carriage 2 moves in the X direction along the guide shaft 5. Ink droplets are discharged from the recording head 3 along with the movement of the carriage 2, so that an image corresponding to one band is recorded on the recording medium. Thereafter, the recording medium is conveyed in the Y direction by one band through the conveyance unit. By repeating the above operations, a predetermined image is formed on the recording medium. In addition, a pulse signal output from the encoder sensor 111 according to the movement of the carriage 2 is counted by the main control portion 100, so that a position of the carriage 2 is detected thereby. The carriage 2 moves to a home position or other positions based on a signal from the encoder sensor 111.

A first exemplary embodiment of the present invention will be described based on the above-described configuration.

Figure 3:
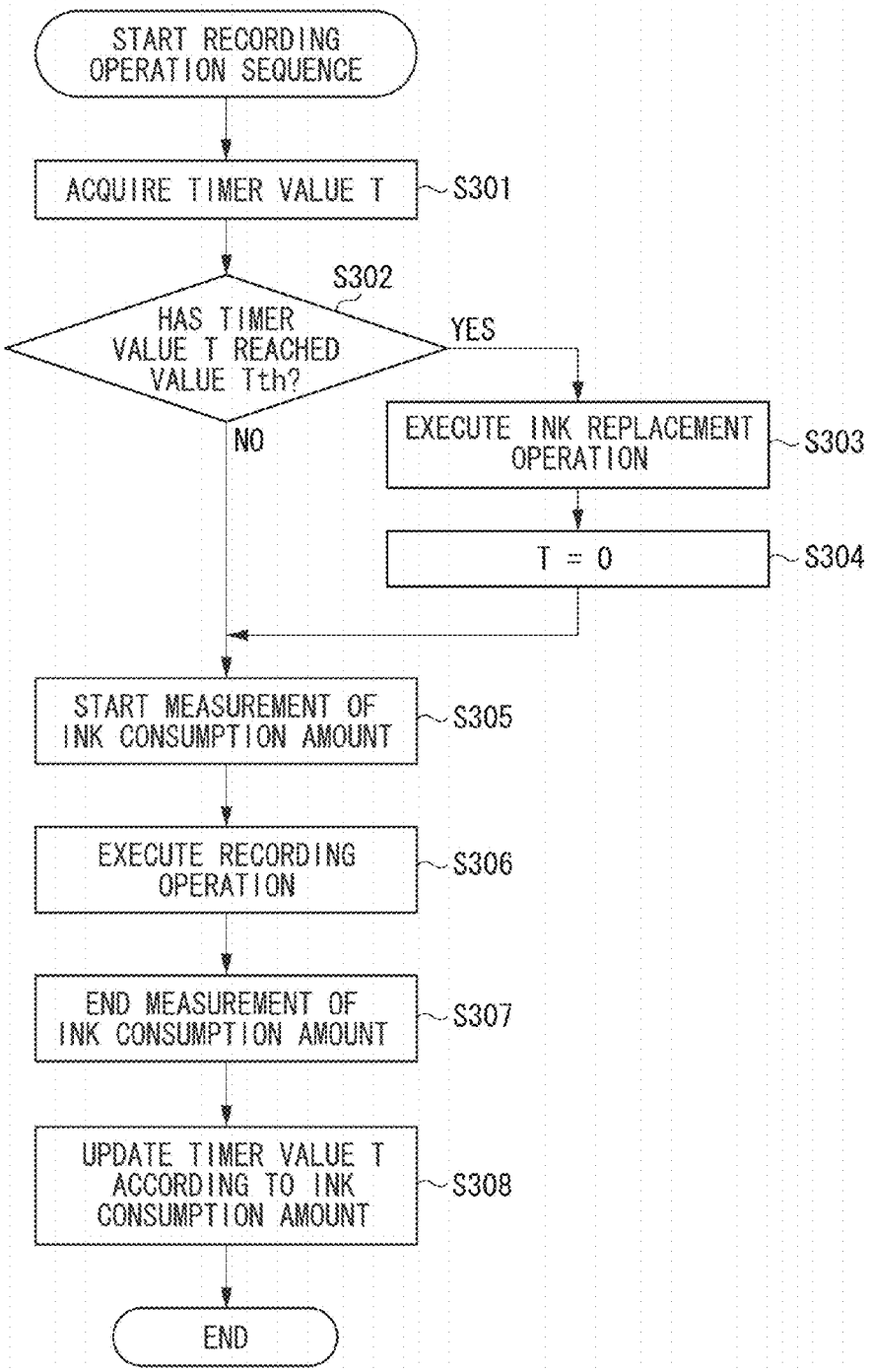
FIG. 3 is a flowchart illustrating a recording operation sequence according to a first exemplary embodiment of the present invention.

FIG. 3 is a flowchart illustrating a recording operation sequence according to the present exemplary embodiment. At first, in step S301, a timer value T is acquired when the recording operation is started. The timer value T is measured within the recording apparatus main body 1. The timer value T is continuously measured regardless of whether the operation is executed by the recording apparatus. The timer value T is a value representing an elapsed time from a previous discharge operation, which is reset to "0" after a discharge operation as described below. Next, in step S302, it is determined whether the timer value T has reached a predetermined time Tth previously determined. The above determination operation is executed in order to determine whether density of ink within the supply tube 4 has a value equal to or greater than a predetermined value. In other words, in a case where the timer value T has reached the predetermined time Tth, it is determined that density of the ink within the supply tube 4 has a value equal to or greater than the predetermine value. In the present exemplary embodiment, it has been known that density of ink will be increased to have a negative effect on an image recording operation if 90 days have passed while the ink within the supply tube 4 has not been consumed during that period. Therefore, in the present exemplary embodiment, the predetermined time Tth is set to 90 days.

Figure 4:
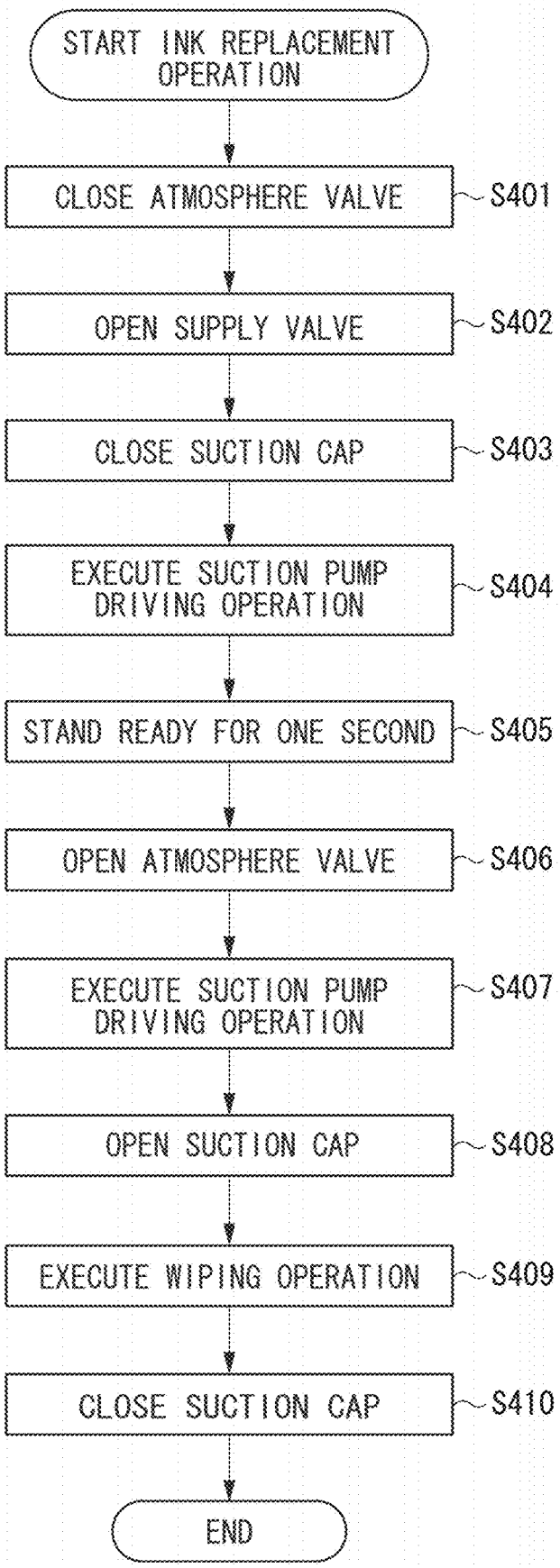
FIG. 4 is a flowchart illustrating an ink replacement operation sequence according to the first exemplary embodiment of the present invention.

In step S302, if it is determined that the timer value T has reached the predetermined time Tth (YES in step S302), the processing proceeds to step S303. In step S303, an ink replacement operation including a discharge operation or discharging ink within the supply tube 4 is executed. FIG. 4 is a flowchart illustrating an ink replacement operation sequence executed in step S303. The ink replacement operation will be described below. First, in step S401, an atmosphere valve disposed on the suction cap 10 is closed. Next, in step S402, the supply valve 14 disposed on the supply tube 4 is opened. Then, in step S403, discharge ports of the recording head 3 are covered by the suction cap 10 and brought into a capping state. Then, in step S404, the suction pump 6 is driven. Herein, because the atmosphere valve is closed, the ink is sucked from the recording head 3 by driving the suction pump 6. A driving time of the suction pump 6 is set to be a time in which the ink within the supply tube is entirely discharged. In the present exemplary embodiment, in order to suck ink of 20 ml corresponding to a volume of the supply tube 4, the suction pump 6 is driven for 100 seconds. Through the above driving operation of the suction pump 6, the ink within the supply tube 4, the density of which has been increased, is entirely sucked by the suction pump 6. Then, new ink is supplied to the supply tube 4 from the ink tank 9, so that the supply tube 4 is filled with ink the density of which has not been increased. Next, in step S405, the suction pump 6 is stopped and stood ready for one second. Thereafter, in step S406, the atmosphere valve of the suction cap 10 is opened. After the atmosphere valve is opened, in step S407, the suction pump 6 is driven again for ten seconds, so that the ink remaining within the suction cap 10 is discharged. Then, in step S408, the suction cap 10 is separated from the recording head 3, so that the capping state thereof is released. Next, in step S409, the wiping operation for cleaning a face of the recording head 3 is executed by the wiping mechanism. After the wiping operation, in step S410, the recording head 3 is brought into a capping state. The ink replacement operation has been described as the above.

In the present exemplary embodiment, in order to suck ink of 20 ml corresponding to a volume of the supply tube 4, the suction pump 6 has been driven for 100 seconds. However, the present invention is not limited to the above. For example, a driving time of the suction pump 6 may be changed according to a volume, a shape, or a material of the supply tube 4. Alternatively, a driving speed of the suction pump may be changed. Further, in the present exemplary embodiment, although the suction pump 6 is driven in a state where the supply valve 14 is opened, the present invention is not limited to the above. For example, the supply valve 14 may be opened after the suction pump 6 is driven in a state where the supply valve 14 is closed in order to increase a negative pressure within the supply tube 4. Furthermore, the discharge operation may be executed through discharge (auxiliary discharge) of ink instead of being executed by the suction pump 6. In addition, the discharge of ink may be executed on the suction cap 10 after the wiping operation. For example, in a case where a suction operation is executed on a recording head having a nozzle array of a plurality of colors by using a single suction cap, there is a risk in which the colors are mixed to each other because of the suction operation. Therefore, there may be a case where ink is discharged on the suction cap in order to solve the color mixture of ink.

Description will be given with reference to the flowchart of FIG. 3 again. After the ink replacement operation is executed in step S303, the processing proceeds to step S304. In step S304, the timer value T is reset to 0. After the timer value T is reset to 0, measurement of the timer value T is started again. Here, the timer value represents an elapsed time after execution of the discharge operation and replacement operation of ink. A timing for executing the subsequent discharge operation and replacement operation of the ink within the supply tube 4 can be determined by measuring the timer value T. After the timer value T is reset in step S304, the processing proceeds to step S305. On the other hand, in step S302, if it is determined that the timer value T has not reached the predetermined time Tth (NO in step S302), the processing also proceeds to step S305. In step S305, measurement of the ink consumption amount to be consumed by the recording operation in step S306 is started. In step S306, the recording operation is executed. After the recording operation is ended, in step S307, the measurement of the ink consumption amount is ended. Herein, an ink consumption amount V consumed in the recording operation is acquired. The ink consumption amount V includes an amount of ink discharged to the outside of the recording medium in addition to an amount of ink discharged on the recording medium by the recording operation. Then, in step S308, based on the measured ink consumption amount V, the timer value T is updated (changed).

Figure 5:
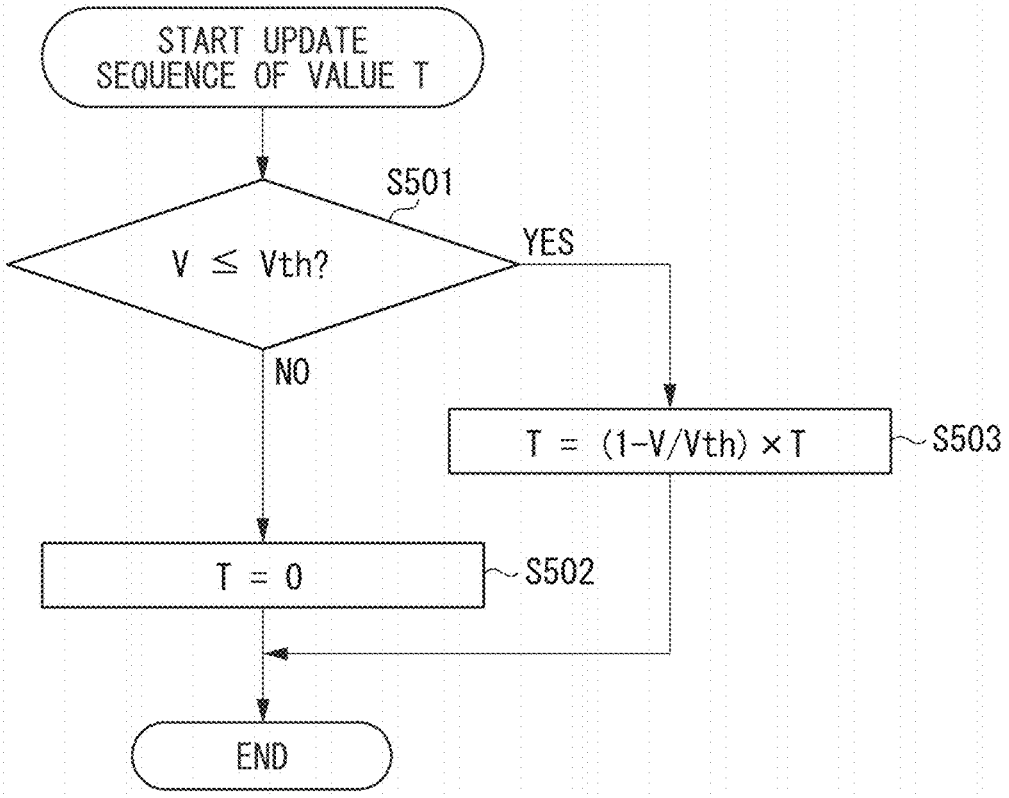
FIG. 5 is a flowchart illustrating an update sequence of a timer value according to the first exemplary embodiment of the present invention.

Hereinafter, an update method of a timer value T according to the present exemplary embodiment will be described. FIG. 5 is a flowchart illustrating an update sequence of the timer value T executed in step S308. First, in step S501, it is determined whether the consumed ink consumption amount V has reached a predetermined amount Vth previously determined. Here, the predetermined amount Vth represents a volume of the supply tube 4, and in the present exemplary embodiment, a value thereof is set to 20 ml. In step S501, if it is determined that the ink consumption amount V has reached the predetermined amount Vth (NO in step S501), the processing proceeds to step S502. In step S502, the timer value T is reset to 0. Then, measurement of the timer value T is started again. In a case where the ink consumption amount V has reached the predetermined amount Vth in step S501, this indicates that ink of an amount equal to or greater than the volume of the supply tube 4 is consumed by the recording operation in step S306. After the ink is consumed, new ink is supplied to the supply tube 4 from the ink tank 9, so that the supply tube 4 is filled with ink the density of which has not been increased. Therefore, as described above, in step S502, the timer value T is reset to 0. After the timer value T is updated to 0, the update sequence of the value T is ended.

On the other hand, in step S501, if it is determined that the ink consumption amount V has not reached the predetermined amount Vth (YES in step S501), the processing proceeds to step S503. In step S503, the timer value T is updated by the following formula 1.

$$T=(1-V/Vth)\times T \quad \text{(Formula 1)}$$

In the above formula 1, the timer value T is changed according to a ratio of the ink consumption amount V with respect to the volume Vth of the supply tube 4. For example, in the present exemplary embodiment, the volume Vth is set to 20 ml. In a case where the ink is consumed by 10 ml, new ink of 10 ml the density of which has not been increased is supplied to the supply tube 4 from the ink tank 9. Therefore, an increase in density of the ink in the supply tube 4 is moderated to half the increase in comparison to the increase before the recording operation. Accordingly, when the ink is consumed by 10 ml, the timer value T is updated to half the value. With this operation, a timing for executing the ink replacement operation including the subsequent discharge operation can be postponed. Then, after the timer value T is updated in step S503, the update sequence of the value T is ended.

As described above, according to the present exemplary embodiment, if the ink is consumed by the recording operation before the elapsed time from the previous discharge operation (replacement operation) has become equal to or greater than the predetermined time, a timing for executing the subsequent discharge operation can be postponed based on the ink consumption amount after the previous discharge operation. Specifically, the elapsed time (timer value T) is updated (changed) to a smaller value if the ink consumption amount is greater. In other words, in a case where the ink consumption amount is equal to or greater than a certain threshold value, a value of the elapsed time is updated to be smaller than in a case where the ink consumption amount is less than the threshold value. Thus, an increase of waste ink caused by the discharge operation can be suppressed by making a time interval between the previous discharge operation and the subsequent discharge operation be longer.

In the present exemplary embodiment, measurement of the ink consumption amount is ended after ending the recording operation. However, the recovery operation may be executed after the recording operation. For example, a face of the recording head 3 may be cleaned by the wiping operation because a large amount of mist is adhered to the face of the recording head 3 after the recording operation. Thereafter, an auxiliary discharge operation may be executed in order to eliminate foreign objects within nozzles, or to solve the color mixture. The ink that is to be consumed by the above-described recovery operation may be also measured as the ink consumption amount V. In such a case, the measurement of the ink consumption amount is ended after ending the recovery operation.

In the first exemplary embodiment, description of a sequence that is to be executed when the recording operation is started has been given. In a second exemplary embodiment, a sequence that is to be executed at a timing that is not directly related to the recording operation will be described. The recording apparatus executes a recovery timing confirmation sequence for executing a recovery operation at a timing at which a power of the recording apparatus main body 1 is turned on, at a timing at which a signal for turning off the power thereof is received, or at a predetermined timing at which a signal of the recording operation is not received. In the present exemplary embodiment, this recovery timing confirmation sequence will be described.

Figure 6:
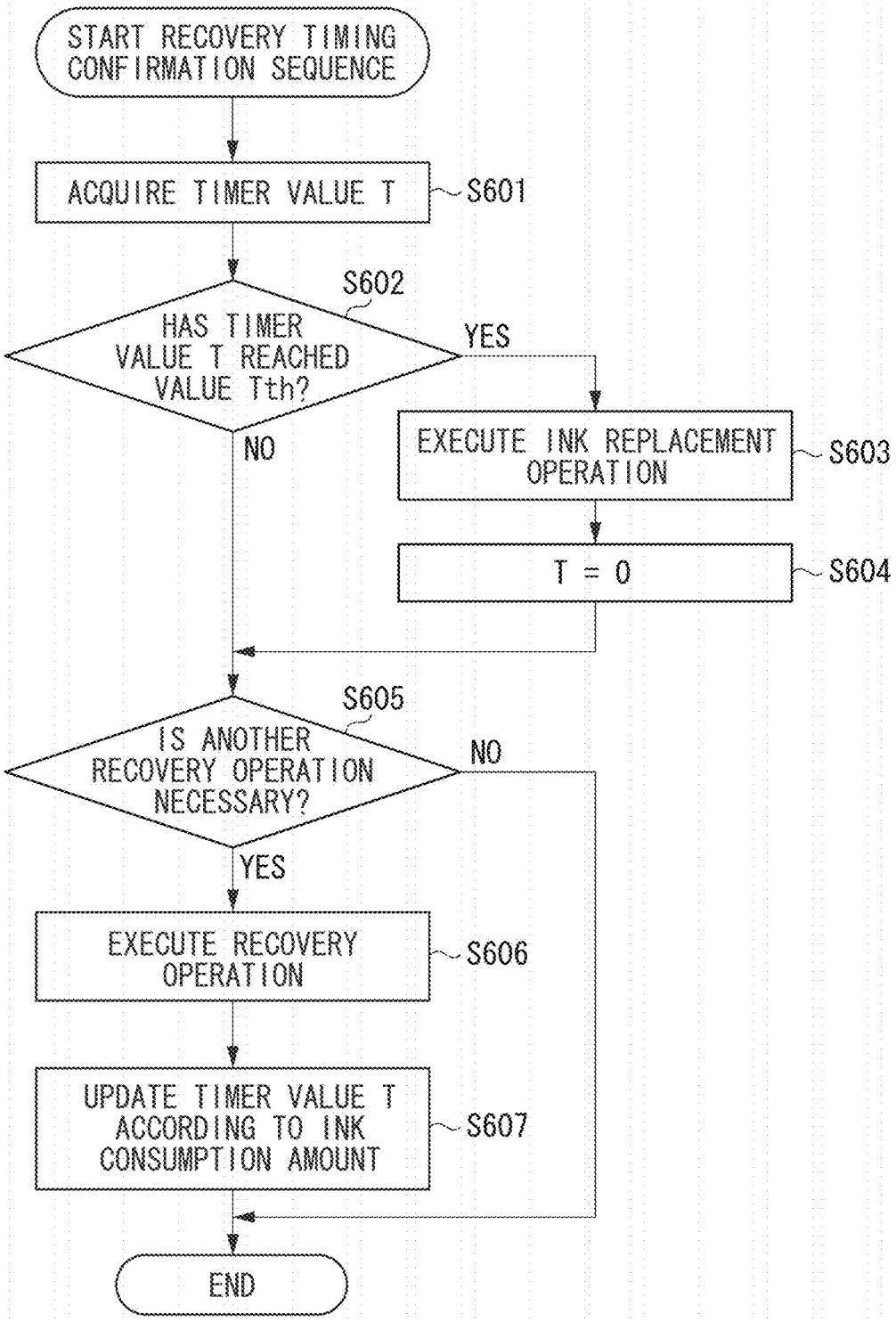
FIG. 6 is a flowchart illustrating a recovery timing confirmation sequence according to a second exemplary embodiment of the present invention.

FIG. 6 is a flowchart illustrating a recovery timing confirmation sequence. At first, in step S601, a timer value T is acquired. Then, in step S602, it is determined whether the acquired timer value T has reached a predetermined time Tth previously determined. In step S602, if it is determined that the timer value T has reached the predetermined time Tth (YES in step S602), the processing proceeds to step S603. In step S603, an ink replacement operation including a discharge operation for discharging ink within the supply tube 4 is executed. The ink replacement operation is the same as that described in the first exemplary embodiment. After the ink replacement operation is executed in step S603, in step S604, the timer value T is reset to 0. After the timer value T is reset thereto, measurement of the timer value T is started again. Thereafter, the processing proceeds to step S605. On the other hand, in step S602, if it is determined that the timer value T has not reached the predetermined time Tth (NO in step S602), the processing also proceeds to step S605. In step S605, it is determined whether a recovery operation other than the ink replacement operation executed in step S603 is necessary. In the present exemplary embodiment, it is determined that the recovery operation is necessary in a case where the ink has not been discharged from the recording head 3 for four hours or more. In step S605, if it is determined that another recovery operation is not necessary (NO in step S605), the recovery timing confirmation sequence is ended. On the other hand, in step S605, if it is determined that another recovery operation is necessary (YES in step S605), the processing proceeds to step S606. In step S606, the recovery operation executed. In the present exemplary embodiment, as a recovery operation, auxiliary discharge for discharging 1000 droplets of ink from each nozzle is executed after the wiping operation is executed on the recording head 3. After the recovery operation is executed, the processing proceeds to step S607. In step S607, the timer value T is updated based on the ink consumption amount consumed by the recovery operation in step S606. The update method of the timer value T is the same as that described in the first exemplary embodiment, and thus description thereof will be omitted.

Further, in the present exemplary embodiment, as a recovery operation, auxiliary discharge is executed after the wiping operation is executed in a case where the ink has not been discharged from the recording head 3 for four hours or more. However, the present invention is not limited thereto. For example, when the power of the recording apparatus is turned on, a suction operation for discharging thickened ink existing in a vicinity of the nozzle may be executed as a recovery operation according to a time in which the power thereof has been turned off. Further, a plurality of recovery operations may be executed instead of executing a single recovery operation. In such case, the timer value T for executing the subsequent discharge operation (replacement operation) of ink is updated after execution of a plurality of the recovery operations based on the ink consumption amount consumed by these recovery operations.

Subsequently, a third exemplary embodiment of the present invention will be described.

Figure 7:
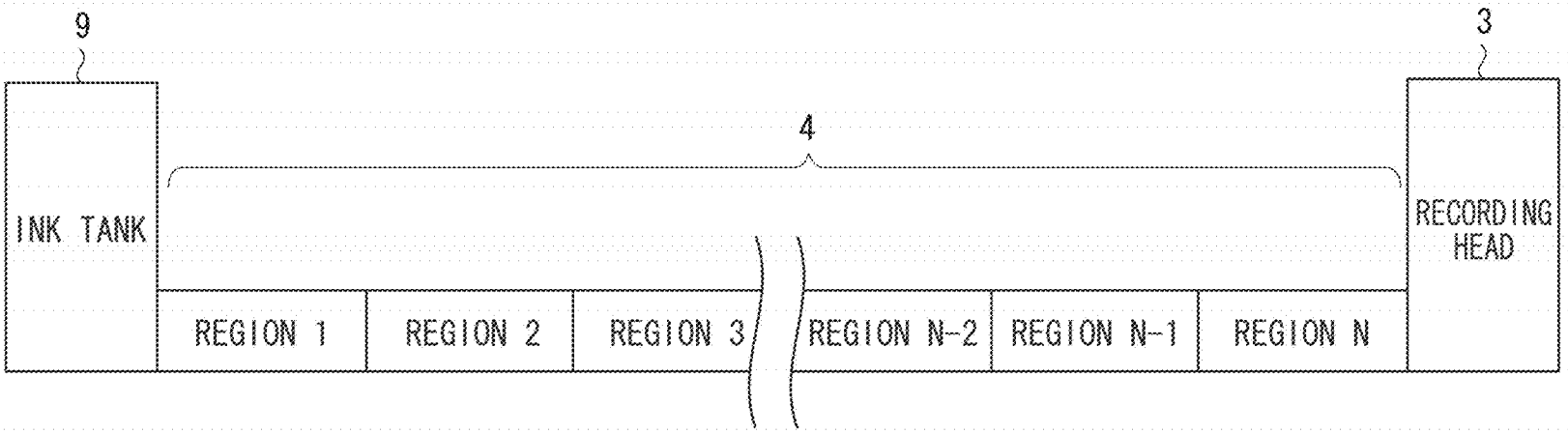
FIG. 7 is a conceptual diagram illustrating an ink supply system according to a third exemplary embodiment of the present invention.

FIG. 7 is a conceptual diagram illustrating an ink supply system according to the present exemplary embodiment. In the present exemplary embodiment, as illustrated in FIG. 7, an interior of the supply tube 4 is divided into N-pieces of predetermined regions. Then, N timer values for determining the ink density of divided regions are set and stored. The divided regions are referred to as a region (1), a region (2), and so on from a region positioned on the side of the ink tank 9, and a region closest to the recording head 3 is referred to as a region (N). Further, the regions (1), (2), . . . , and (N) respectively correspond to the timer values T1, T2, . . . , and TN.

Figure 8:
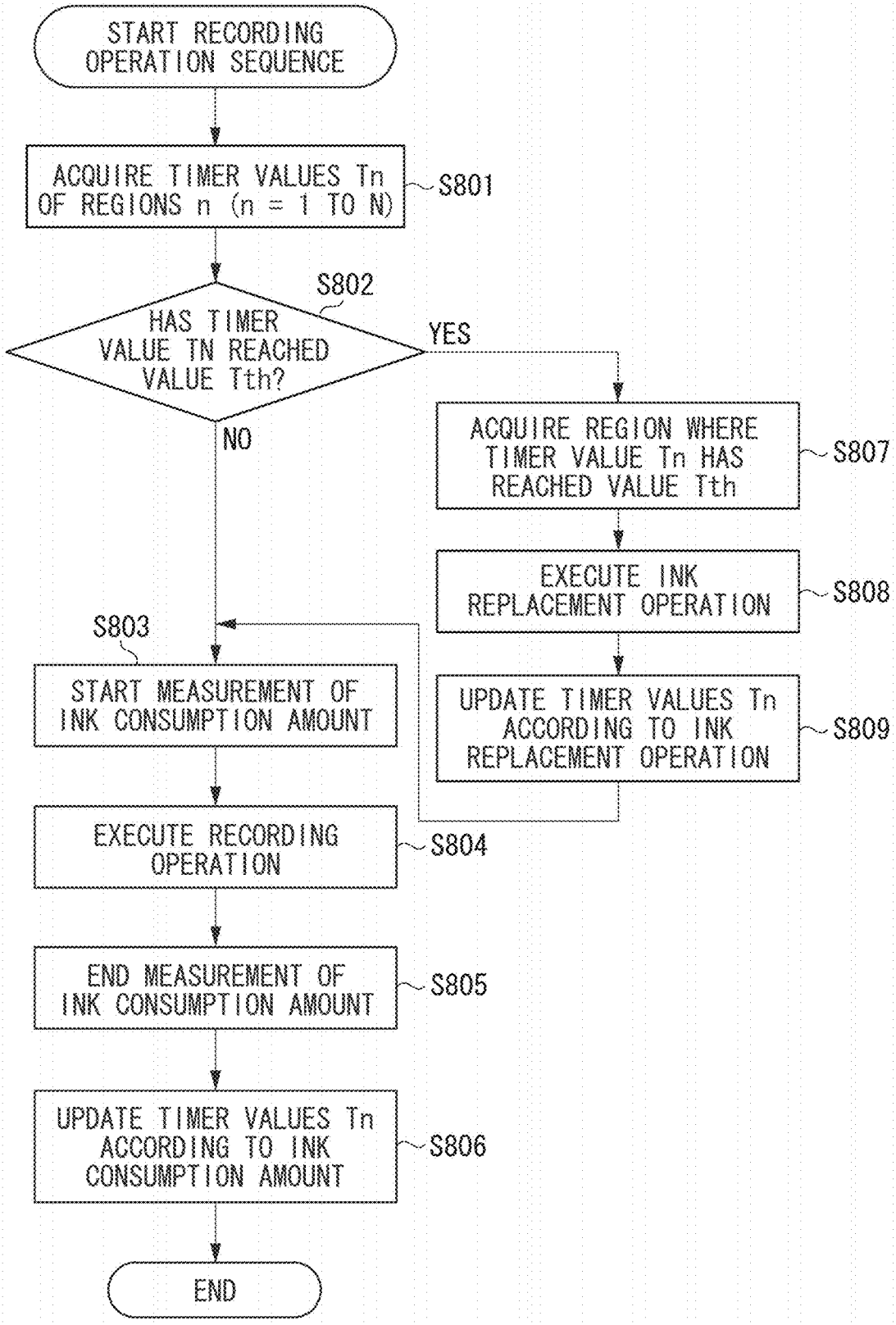
FIG. 8 is a flowchart illustrating a recording operation sequence according to the third exemplary embodiment of the present invention.

FIG. 8 is a flowchart illustrating a recording operation sequence according to the present exemplary embodiment. After the recording operation is started, at first, in step S801, timer values Tn of respective regions "n" (n=1 to N) are acquired. Then, in step S802, it is determined whether the timer value TN has reached the predetermined time Tth. If it is determined that the timer value TN has not reached the predetermined time Tth (NO in step S802), the processing proceeds to step S803. In step S803, measurement of the ink consumption amount is started, and the processing proceeds to step S804. In step S804, the recording operation is executed. At this time, the ink consumption amount V consumed through the recording head 3 is measured. Then, after the recording operation is ended, in step S805, the measurement of the ink consumption amount V is ended. In step S806, based on the measured ink consumption amount V, the timer values Tn of respective regions (1) to (N) are updated.

Figure 9:
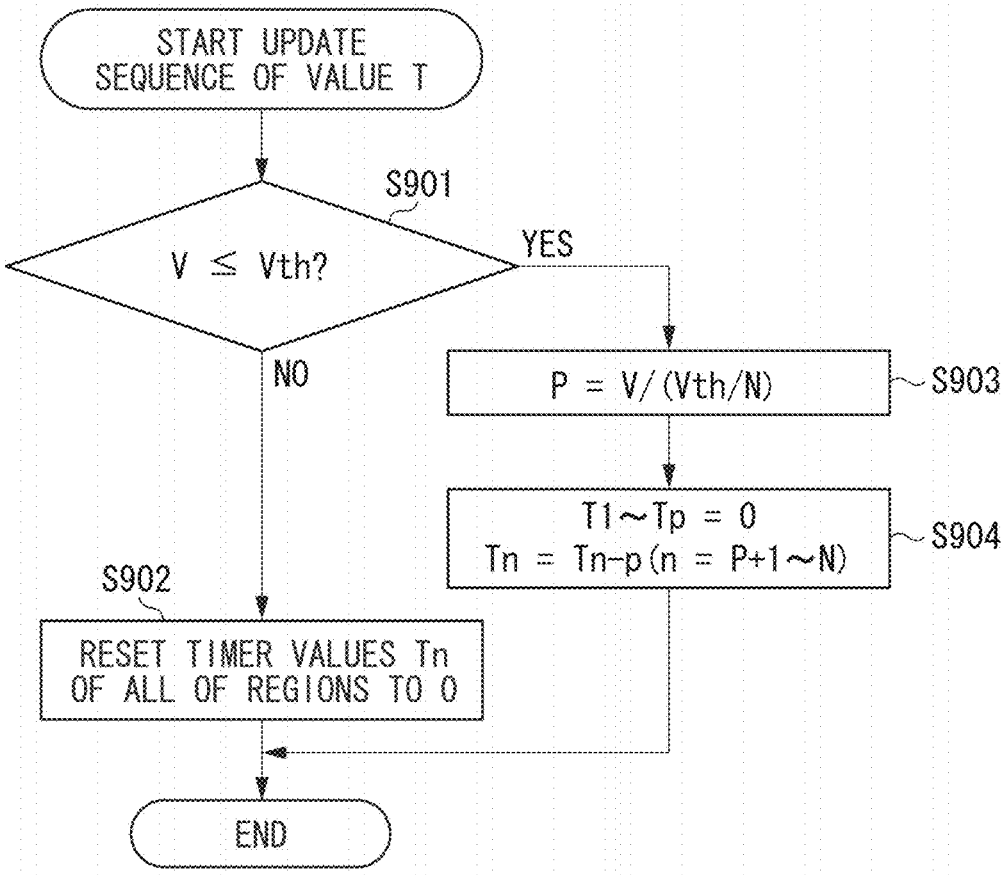
FIG. 9 is a flowchart illustrating an update sequence of a timer value according to the third exemplary embodiment of the present invention.

Hereinafter, an update method of the timer value T according to the present exemplary embodiment will be described. FIG. 9 is a flowchart illustrating an update sequence of the timer value T executed in step S806. First, in step S901, it is determined whether the consumed ink amount V has reached an amount Vth previously determined. Here, the predetermined amount Vth represents a volume of the supply tube 4, and in the present exemplary embodiment, the value thereof is set to 20 ml. In step S901, if it is determined that the ink consumption amount V has reached the predetermined amount Vth (NO in step S901), the processing proceeds to step S902. In step S902, the timer values Tn of all of the regions in the supply tube 4 are reset to 0. Then, measurement of the timer values Tn is started again. In a case where the ink consumption amount V has reached the predetermined amount Vth in step S901, this indicates that ink of an amount equal to or greater than the volume of the supply tube 4 is consumed by the recording operation in step S804. After the ink is consumed, new ink is supplied to the supply tube 4 from the ink tank 9, so that the supply tube 4 is filled with ink the density of which has not been increased. Accordingly, described in step S902, the timer values Tn are reset to 0. After, the timer values Tn are reset to 0, the update sequence of the value T is ended.

On the other hand, in step S901, if it is determined that the ink consumption amount V has not reached the predetermined amount Vth (YES in step S901), the processing proceeds to step S903. In step S903, a value that represents to what region of the supply tube 4 the new ink is supplied from the ink tank 9 after the consumption of ink is calculated through the following formula 2.

$$P=V/(Vth/N) \qquad \text{Formula 2}$$

In the present exemplary embodiment, the decimal places are rounded down in order to acquire a value P through the above formula 2. Based on the value P calculated from the above formula 2, it is determined that the ink in the regions (1) to (P) of the supply tube 4 is consumed, and the regions (1) to (P) are filled with new ink from the ink tank 9. Next, in step S904, the timer values T1 to Tp corresponding to the regions (1) to (P) are reset to 0.

Further, with respect to the regions (P+1) to (N), the timer values Tn are updated by the following formula 3.

$$Tn=Tn-p,\ (n=P+1 \text{ to } N) \qquad \text{Formula 3}$$

For example, when the value P is 4 (P=4), the timer value TN of the region (N) is updated to "T (N−4)" (TN=T(N−4)). In other words, the timer value of the region (N) after the recording operation is replaced with a timer value of the region (N−4) before the recording operation. This indicates that the ink that has existed in the region (N−4) before the recording operation is determined to move to the region (N) because of the consumption of ink caused by the recording operation, and thus the timer value thereof is updated according to the movement of the ink. Similarly, timer values Tn of the regions (P+1) to (N) are updated through the above formula 3. As described above, the update sequence of the value T is ended when the timer values Tn of all of the regions (1) to (N) are updated.

Description will be given with reference to the flowchart of FIG. 8 again. In step S802, if it is determined that the timer value TN has reached the time Tth previously determined (YES in step S802), the processing proceeds to step S807. In step S807, it is determined whether the timer values Tn corresponding to the regions (1) to (N−1) have reached the predetermined time Tth. Here, the timer values Tn of all of the regions may be referred to in order to check whether the timer values Tn have reached the predetermined time Tth. For example, the timer values Tn may be checked as follows. First, it is determined whether the timer value of the region (N−1) has reached the predetermined time Tth. If the timer value of the region (N−1) has not reached the predetermined time Tth, it is determined that the timer values of the regions (N−2) to (1) have not reached the predetermined time Tth. Further, if the timer value of the region (N−1) has reached the predetermined time Tth, subsequently, it is determined whether the timer value of the region (N−2) has reached the predetermined time Tth. As described above, it is possible to check the regions in the order from the region (N−1) to the region where the timer value has not reached the predetermined time Tth. This is because the timer values Tn of N-pieces of the regions are either equal to the others or increased toward the region (N) from the region (1). Because of the ink consumption caused by the recording operation, the interior of the supply tube 4 is filled with ink the density of which has not been increased in the order from the region (1). Therefore, density of the ink is relatively lower at the region (1) from among the regions (1) to (N). In other words, the timer value is smaller in a region closer to the region (1) from among the regions (1) to (N).

Figure 10A:
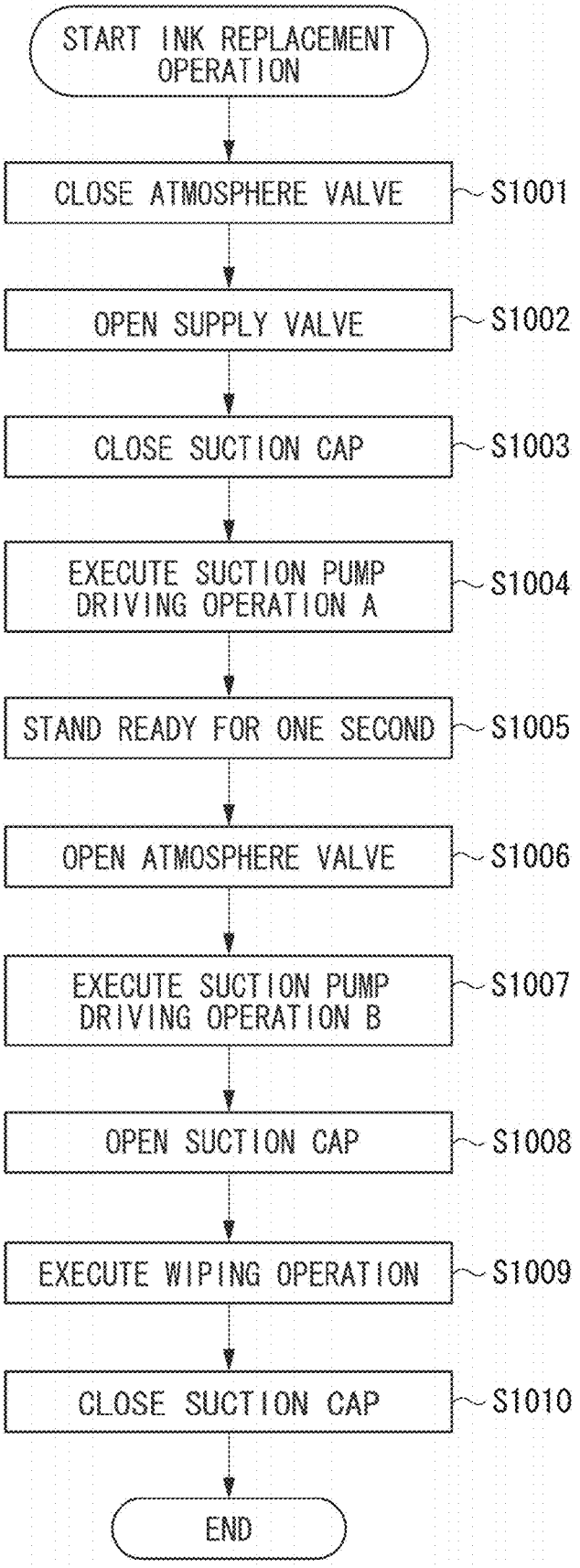
FIG. 10A is a flowchart illustrating an ink replacement operation sequence according to the third exemplary embodiment of the present invention.

Then, in step S808, the ink replacement operation including a discharge operation for discharging ink within the supply tube 4 is executed. Here, at least ink corresponding to the ink within the regions where the timer values have exceeded the predetermined time Tth in the supply tube 4 is discharged. FIG. 10A is a flowchart illustrating the ink replacement operation sequence according to the present exemplary embodiment executed in step S808. The ink replacement operation illustrated in FIG. 10A is different from the ink replacement operation in FIG. 4 described in the first exemplary embodiment, in the processing executed in step S1004. Here, the processing different from the above-described exemplary embodiment will be described. In step S1004, the ink within the supply tube 4 is discharged by driving the suction pump 6. Here, the driving time of the suction pump 6 is changed based on the number of regions where the timer values have exceeded the predetermined time Tth. FIG. 10B is a table illustrating a relationship between the suction time and the number of regions where the timer values have exceeded the predetermined time Tth. In the present invention, a total number of regions N is set to 100, whereas a volume of each region is set to 0.2 ml. The number of regions where the timer values have exceeded the predetermined time Tth has already been calculated in step S807. Here, for example, if the number of regions where the timer values have exceeded the predetermined time Tth is twenty-three, the driving time of the suction pump 6 is set to twenty-five seconds as illustrated in FIG. 10B. The ink amount of 5 ml is discharged through the above driving time of the suction pump 6. Further, if the number of regions where the timer values have exceeded the predetermined time Tth is eighty, the driving time of the suction pump 6 is set to 100 seconds as illustrated in FIG. 10B. The ink amount of 20 ml is discharged through the above driving time of the suction pump 6. In the present exemplary embodiment, in order to reliably discharge the ink in the regions where the timer values have exceeded the predetermined time Tth, the driving time of the suction pump 6 is set by dividing the number of regions into four sections while taking the variation in suction amounts into consideration. However, according to the present invention, the driving time can be set more finely. Alternatively, the driving time can be set more roughly. For example, the ink within the supply tube 4 may be discharged entirely if the timer value of the region (N) simply exceeds the predetermined time Tth. As described above, the driving time of the suction pump 6 is changed according to the number of regions where the timer values have exceeded the predetermine time Tth. Specifically, an amount of ink discharged by the suction pump 6 is set to be larger when the number of regions where the timer values have exceeded the predetermined time Tth is greater. In other words, in a case where the number of regions where the timer values have exceeded the predetermined time Tth is equal to or greater than a predetermined number, an amount of ink that is to be discharged by the suction pump 6 is larger than in a case where the number of regions where the timer values have exceeded the predetermined time Tth is less than the predetermined number. With this configuration, the ink in the regions where the timer values have exceeded the predetermined time Tth is discharged while the ink in the regions where the timer values have not exceeded the predetermined time Tth is suppressed from being discharged, and thus it is possible to suppress the increase of waste ink.

Description will be given with reference to the flowchart of FIG. 8 again. After the ink replacement operation is ended in step S808, in step S809, the timer values Tn of respective regions are updated. FIG. 11 is a table illustrating an update method of the timer value according to the present exemplary embodiment. In the present exemplary embodiment, in step S808, the driving time of the suction pump 6 is changed according to the number of regions where the timer values have exceeded the predetermined time Tth. Here, a value for updating the timer value is changed according to the driving time of the suction pump 6. For example, in step S808, in a case where the driving time of the suction pump 6 is twenty-five seconds, ink of 5 ml is discharged while ink of 5 ml is newly supplied from the ink tank 9. Because the ink amount of 5 ml corresponds to the ink amount of twenty-five regions in the supply tube 4, the regions (1) to (25) are determined to be filled with new ink the density of which has not been increased, so that the timer values of the regions (1) to (25) are updated to 0. On the other hand, for example, with respect to the region (26), it is determined that the ink that has existed in the region (1) before the ink replacement operation has moved to the region (26) because of the ink replacement operation. Therefore, the timer value of the region (26) after the ink replacement operation is updated by the timer value of the region (1) before the ink replacement operation. In other words, the timer values of the regions of and subsequent to the region (26) are replaced with the timer values of the regions up to the region (25) before the ink replacement operation. As described above, the timer values Tn are updated based on the ink consumption amount based on the ink replacement operation executed in step S808. After the timer values Tn of respective regions are updated, the processing proceeds to step S803. The processing in step S803 and the subsequent steps has already been described, and thus descriptions thereof will be omitted.

In the present exemplary embodiment, although the timer values are updated in order to determine the ink density of respective regions, a value that is to be updated does not have to be the timer value. Any method capable of determining the ink density of respective regions may be used, and thus the ink replacement operation may be executed depending on whether the ink density of respective regions have exceeded the predetermined value.

Subsequently, a fourth exemplary embodiment of the present invention will be described.

In the third exemplary embodiment, the recording operation sequence in which an interior of the supply tube 4 is divided into N-pieces of regions while timer values are set and stored with respect to the divided regions has been described. In the present exemplary embodiment, a sequence that is to be executed at a timing that is not directly related to the recording operation through a configuration similar to the configuration described in the third exemplary embodiment will be described.

Figure 12:
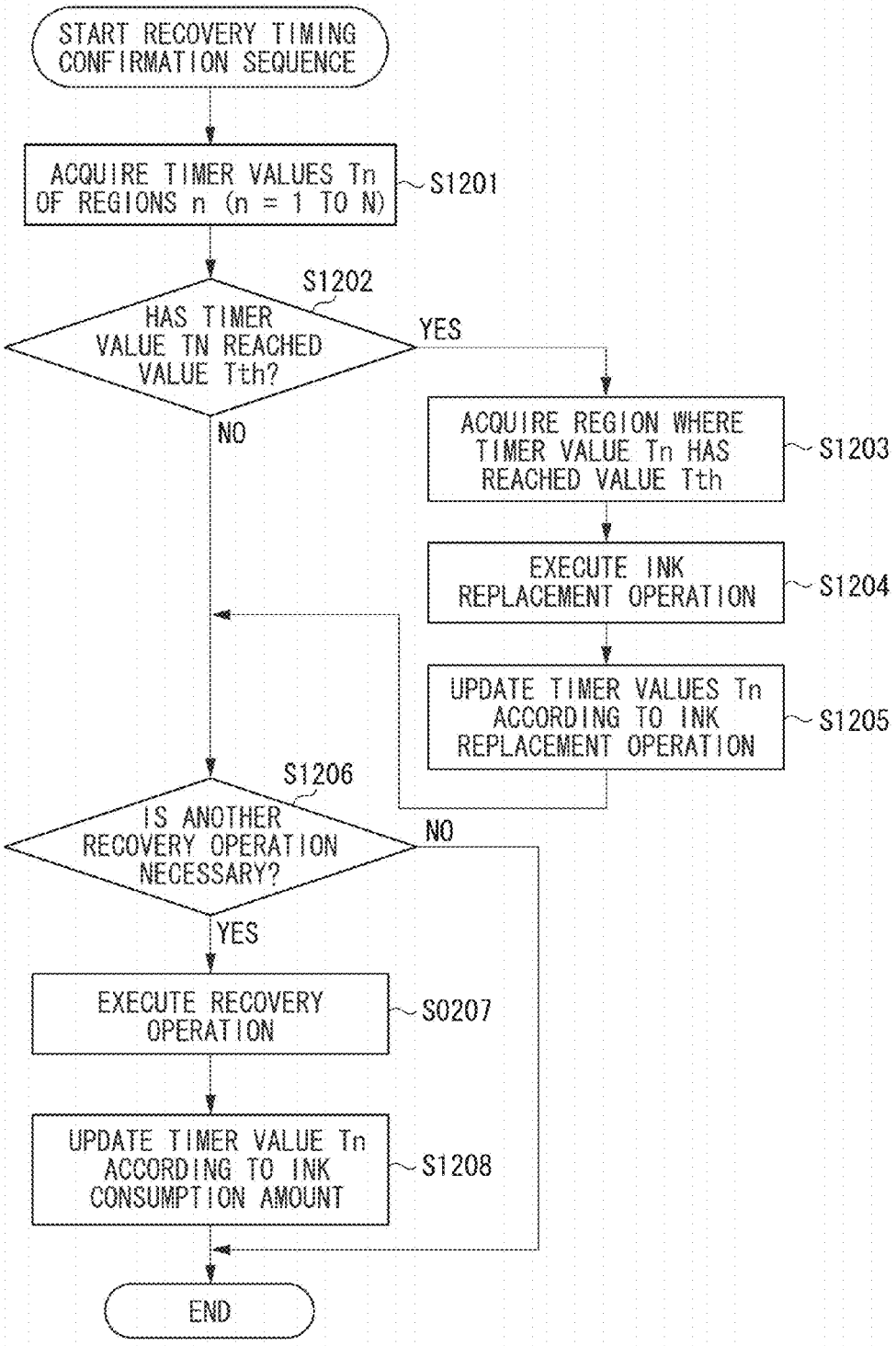
FIG. 12 is a flowchart illustrating a recovery timing confirmation sequence according to a fourth exemplary embodiment of the present invention.

FIG. 12 is a flowchart illustrating a recovery timing confirmation sequence according to the present exemplary embodiment. As described in the second exemplary embodiment, the recovery timing confirmation sequence is executed at a timing at which the power of the recording apparatus main body 1 is turned on, at a timing at which a signal for turning off the power thereof is received, and at a predetermined timing at which a signal of the recording operation is not received. First, in step S1201, timer values Tn of respective regions are acquired. Next, in step S1202, it is determined whether the timer value TN of the region (N) has reached the time Tth previously determined. In step S1202, if it is determined that the timer value TN has reached the predetermined time Tth (YES in step S1202), the processing proceeds to step S1203. In step S1203, it is determined whether timer values Tn corresponding to the regions (1) to (N−1) have reached the predetermined time Tth. Then, in step S1204, the ink replacement operation is executed according to the number of regions where the timer values Tn have exceeded the predetermined time Tth. Then, in step S1205, the timer values Tn of respective regions are updated based on the ink consumption amount based on the ink replacement operation executed in step S1204. Thereafter, the processing proceeds to step S1206. The content of processing executed in steps S1203 to S1205 is the same as that of the processing executed in the third exemplary embodiment, and thus description thereof will be omitted.

On the other hand, in step S1202, if it is determined that the timer value TN has not reached the predetermined time Tth (NO in step S1202), the processing also proceeds to step S1206. In step S1206, it is determined whether a recovery operation other than the ink replacement operation executed in step S1204 is necessary. In the present exemplary embodiment, it is determined that another recovery operation is necessary in a case where the ink has not been discharged from the recording head 3 for four hours or more. In step S1206, if it is determined that another recovery operation is not necessary (NO in step S1206), the recovery timing confirmation sequence is ended. On the other hand, in step S1206, if it is determined that another recovery operation is necessary (YES in step S1206), the processing proceeds to step S1207. In step S1207, the recovery operation is executed. In the present exemplary embodiment, as the recovery operation, the wiping operation is executed on the recording head while the ink of 1 ml is sucked from the recording head 3. After the recovery operation is executed, the processing proceeds to step S1208. In step S1208, the timer values Tn of respective regions are updated based on the ink consumption amount consumed by the recovery operation in step S1207. In the present exemplary embodiment, an ink consumption amount of 1 ml corresponds to the volume of two divided regions. Therefore, the timer values of the regions (1) and (2) are set to 0. Further, with respect to the timer values of the region (3) and the subsequent regions, a timer value of one region is replaced with a timer value of another region on the side of the ink tank 9 positioned next to a region adjacent to the one region before the ink replacement operation. Details thereof will be omitted as the processing has already been described in the third exemplary embodiment.

Next, a fifth exemplary embodiment of the present invention will be described.

In the first exemplary embodiment, the timer value T has been updated based on the ink consumption amount. In the present exemplary embodiment, a value of the predetermined time Tth will be updated.

Figure 13:
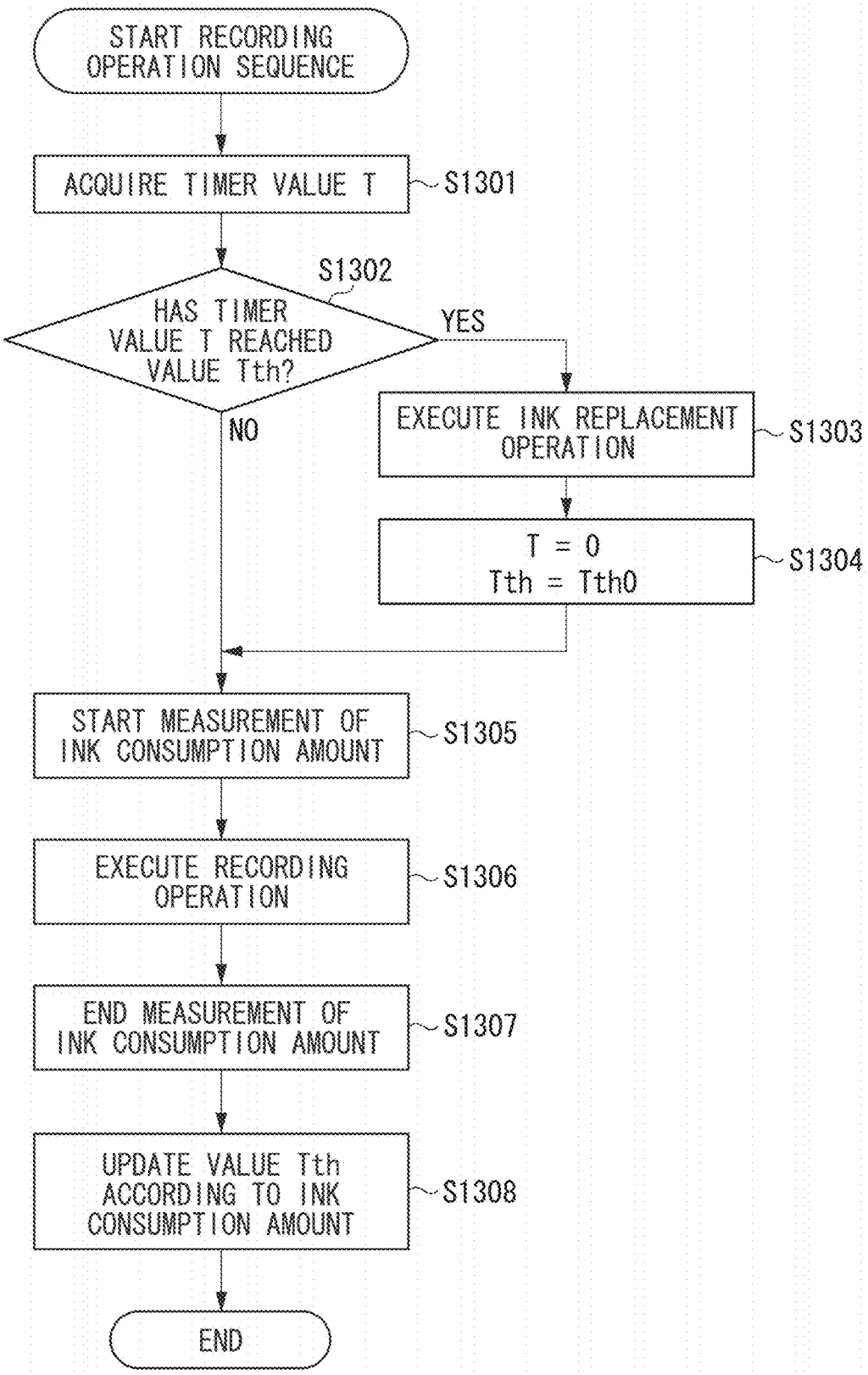
FIG. 13 is a flowchart illustrating a recording operation sequence according to a fifth exemplary embodiment of the present invention.

FIG. 13 is a flowchart, illustrating a recording operation sequence according to the present exemplary embodiment. Here, only steps S1304 and S1308 different from the processing described in the first exemplary embodiment will be described in detail.

Similar to the first exemplary embodiment, in step S1302, if it is determined that the timer value T has reached the predetermined time Tth (YES in step S1302), the processing proceeds to step S1303. In step S1303 the ink replacement operation is executed, and the processing proceeds to step S1304. In step S1304, the timer value T is set to 0, and a value of the predetermined time Tth is updated to a time Tth0 previously determined. The predetermined time Tth0 represents a time that causes the density of ink to increase to have an influence on a recorded image unless the ink is consumed during that time, which also represents a time until the next suction operation is required. In the present exemplary embodiment, the predetermined time Tth0 is set to 90 days. When the ink within the supply tube 4 is discharged and replaced with new ink, the predetermined time Tth is updated to the predetermined time Tth0. The details thereof will be described below. Then, in step S1308, a value of the predetermined time Tth is updated.

Figure 14:
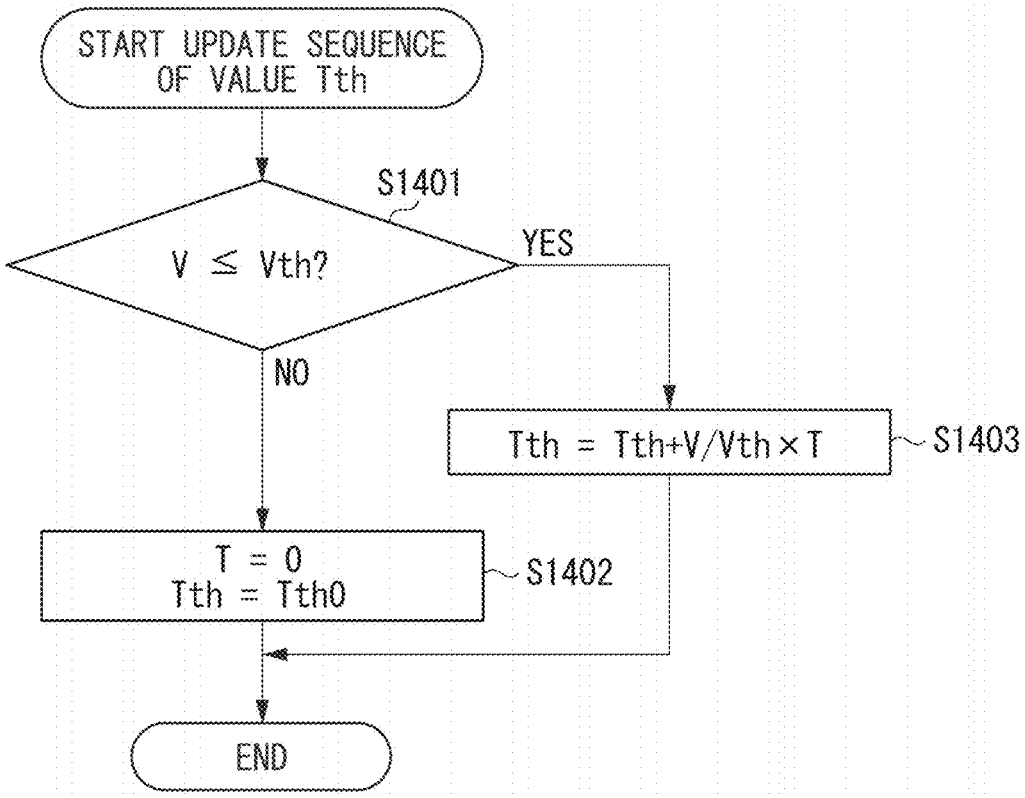
FIG. 14 is a flowchart illustrating an update sequence of a timer value according to the fifth exemplary embodiment of the present invention.

FIG. 14 is a flowchart illustrating the update sequence of the predetermined time Tth executed in step S1308. First, in step S1401, it is determined whether the ink consumption amount V has reached the predetermined amount Vth. Here, the predetermined amount Vth represents a volume of the supply tube 4, and in the present exemplary embodiment, the value thereof is set to 20 ml. In step S1401, if it is determined that the ink consumption amount V is equal to or greater than the predetermined amount Vth (NO in step S1401), the processing proceeds to step S1402. Then, in step S1402, the timer value T is set to 0, and a value of the predetermined time Tth is updated to the predetermined time Tth0 that is a value previously determined. This indicates that the time until the next ink replacement operation is required is set to the predetermined time Tth0 because the ink within the supply tube 4 is entirely discharged by the recording operation and the supply tube 4 is filled with new ink the density of which has not been increased.

On the other hand, in step S1401, if it is determined that the ink consumption amount V has not reached the predetermined amount Vth (YES in step S1401), the processing proceeds to step S1403. In step S1403, the predetermined time Tth is updated through the following formula 4.

$$Tth = Tth + V/Vth \times T \qquad \text{Formula 4}$$

In the above formula 4, a value of the predetermined time Tth is changed based on the ratio of the ink consumption amount V relative to the volume Vth of the supply tube 4. In the first exemplary embodiment, the timer value T has been updated to a smaller value based on the ink consumption amount. However, in the present exemplary embodiment, a value of the predetermined time Tth is updated to a greater value without changing the timer value T.

As described above, according to the present exemplary embodiment, if the ink is consumed by the recording operation before the elapsed time from the previous discharge operation (replacement operation) has become equal to or greater than the predetermined time, a timing for executing the subsequent discharge operation can be postponed based on the ink consumption amount after the previous discharge operation. Specifically, the predetermined time Tth is updated (changed) to a greater value if the ink consumption amount is greater. In other words, in a case where the ink consumption amount is equal to or greater than a certain threshold value, a value of the predetermine time is updated to be greater than in a case where the ink consumption amount is less than the threshold value. Thus, an increase of waste ink caused by the discharge operation can be suppressed by making a time interval between the previous discharge operation and the subsequent discharge operation longer.

Next, a sixth exemplary embodiment of the present invention will be described.

In the present exemplary embodiment, similar to the configuration described in third exemplary embodiment, an interior of the supply tube 4 is divided into N-pieces of regions while timer values are set and stored with respect to the divided regions.

Figure 15:
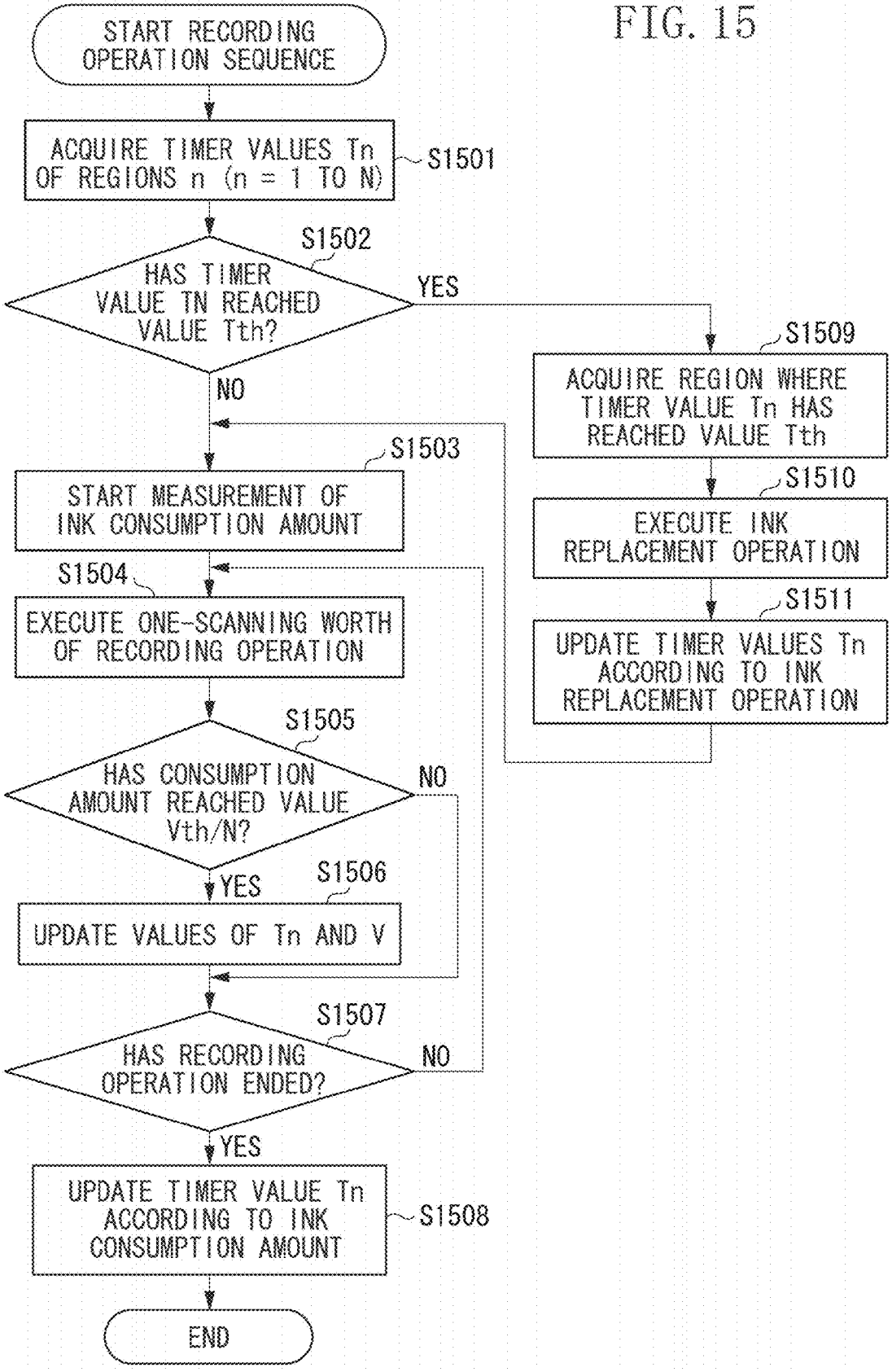
FIG. 15 is a flowchart illustrating a recording operation sequence according to a sixth exemplary embodiment of the present invention.

FIG. 15 is a flowchart illustrating a recording operation sequence according to the present exemplary embodiment. After the recording operation is started, at first, in step S1501, timer values Tn of respective regions "n" (n=1 to N) are acquired. Then, in step S1502, it is determined whether the timer value TN has reached the time Tth previously determined. If it is determined that the timer value TN has not reached the predetermined time Tth (NO in step S1502), the processing proceeds to step S1503. In addition, similar to the third exemplary embodiment, the timer value TN is a timer value corresponding to the region (N) closest to the recording head 3. The timer values are either equal to the others or increased toward the timer value TN from the timer value T1. Therefore, if the timer value TN has not reached the predetermined time Tth, the timer values T1 to T(N−1) also have not reached the predetermined time Tth. In step S1503, measurement of an ink consumption amount V consumed by the subsequent recording operation is started. Then, in step S1504, one-scanning worth of the recording operation is executed. Then, one-scanning worth of the ink consumption amount V is measured. In step S1505, it is determined whether the measured ink consumption amount V has reached a predetermined amount Vth/N. In the present exemplary embodiment, a volume Vth of the supply tube 4 is set to 20 ml while the number of divided regions N is set to 4, and the predetermined amount Vth/N is set to 5 ml. In a case where the ink consumption amount V has not reached 5 ml, the processing proceeds to step S1507. In step S1507, it is determined whether the recording operation is ended. If the recording operation is not ended (NO in step S1507), the processing proceeds to step S1504, so that one-scanning worth of the recording operation is executed. When all of the scanning operations (recording operations) are ended, amounts of ink consumed by the preceding scanning operations are added together. Then, in step S1505, it is determined whether that ink consumption amount has reached 5 ml. If the ink consumption amount has reached 5 ml (YES in step S1505), the processing proceeds to step S1506. In step S1506, the timer values Tn of respective regions (1) to (4) and a value of the ink consumption amount V are updated.

Figure 16:
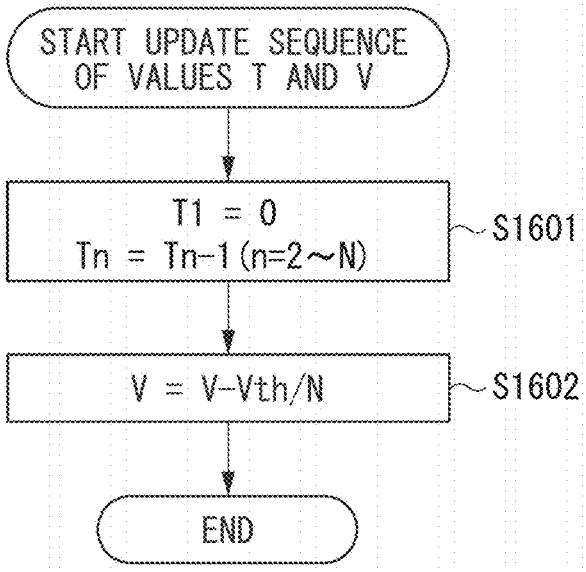
FIG. 16 is a flowchart illustrating an update sequence of a timer value and an ink consumption amount according to the sixth exemplary embodiment of the present invention.

Hereinafter, an update method of the timer value T and the ink consumption amount V according to the present exemplary embodiment will be described. FIG. 16 is a flowchart illustrating the update sequence of the timer value T and the ink consumption amount V executed in step S1506. First, in step S1601, the timer value T1 is updated to 0. In the present exemplary embodiment, because each of the divided regions in the supply tube 4 has a volume of 5 ml, when ink of 5 ml is consumed by the recording operation, this indicates that the ink of the region (1) is entirely replaced with new ink supplied from the ink tank 9. Therefore, the timer value T1 is updated to 0 because the ink in the region (1) is replaced with ink the density of which has not been increased. Further, the timer value T2 and the subsequent timer values are updated by the following formula 5.

$$Tn=Tn-1,\ (n=2 \text{ to } N) \qquad \text{Formula 5}$$

In the above formula 5, as it is determined that the ink of the region (1) in the supply tube 4 is consumed while the ink of the region 2 and the subsequent regions is replaced with the ink of one adjacent region positioned on the side of the ink tank 9, each of the timer values Tn is replaced with the timer value of the one adjacent region positioned on the side of the ink tank 9.

Then, the processing proceeds to step S1602. In the above, the timer value has been updated with respect to the ink consumption amount up to 5 ml. However, a timer value has not been updated with respect to the ink consumption amount exceeding 5 ml. Therefore, the ink consumption amount V is updated by the following formula 6.

$$V=V-Vth/N \qquad \text{Formula 6}$$

In the present exemplary embodiment, the predetermined amount Vth/N is set to 5 ml. Therefore, for example, if ink of 5.5 ml is consumed, the ink consumption amount V is updated from 5.5 ml to 0.5 ml. When the ink consumption amount V is updated through the formula 6, the update sequence of respective values T and V is ended.

Description will be given with reference to the flowchart of FIG. 15 again. If the recording operation is ended in step S1507 (YES in step S150), the processing proceeds to step S1508. In step S1508, the timer values Tn are updated based on the ink consumption amount V. The timer values Tn are updated by the following formulas 7 and 8.

$$T1-(1-V/(Vth/N))\times T1 \qquad \text{Formula 7}$$

$$Tn=(1-V/(Vth/N))\times Tn+V/(Vth/N)\times Tn-1,\ (n=2 \text{ to } N) \qquad \text{Formula 8}$$

In the present exemplary embodiment, the ink consumption amount V up to this point should be a value less than 5 ml, i.e., a value less than one-region worth of volume in the supply tube 4. With respect to the region (1), it is determined that the ink the density of which has not been increased is supplied thereto from the ink tank 9 by an amount corresponding to the ink consumption amount V. In other words, it is determined that the increase in density is moderated by the ratio of the supplied ink amount V to the ink amount of the region (1), and the timer value T1 corresponding to the region (1) is updated by the above formula 7. Further, with respect to the region (2), it is determined that the ink that has existed in the region (1) is moved thereto by an amount corresponding to the ink consumption amount V. In other words, it is determined that a mixture of inks, which consists of the ink of the ink amount V existed in the region (1), having the density increased by the timer value T1, and the ink of the ink amount Vth/N−V existed in the region 2, having the density increased by the timer value T2, newly exists in the region (2). Therefore, the timer value T2 is updated to a new timer value based on the ratio of the timer value and the ink amount through the above formula 8. As described above, the timer values T2 to TN are updated. Then, the recording operation sequence is ended.

On the other hand, in step S1502, if the timer value TN has reached the predetermined time Tth (YES in step S1502), the processing proceeds to step S1509. In step S1509, it is checked whether the timer values Tn of respective regions have reached the predetermined time Tth. Then, the number of regions where the timer values Tn have reached the predetermined time Tth is acquired. Then, in step S1510, the ink replacement operation is executed.

Figure 17:
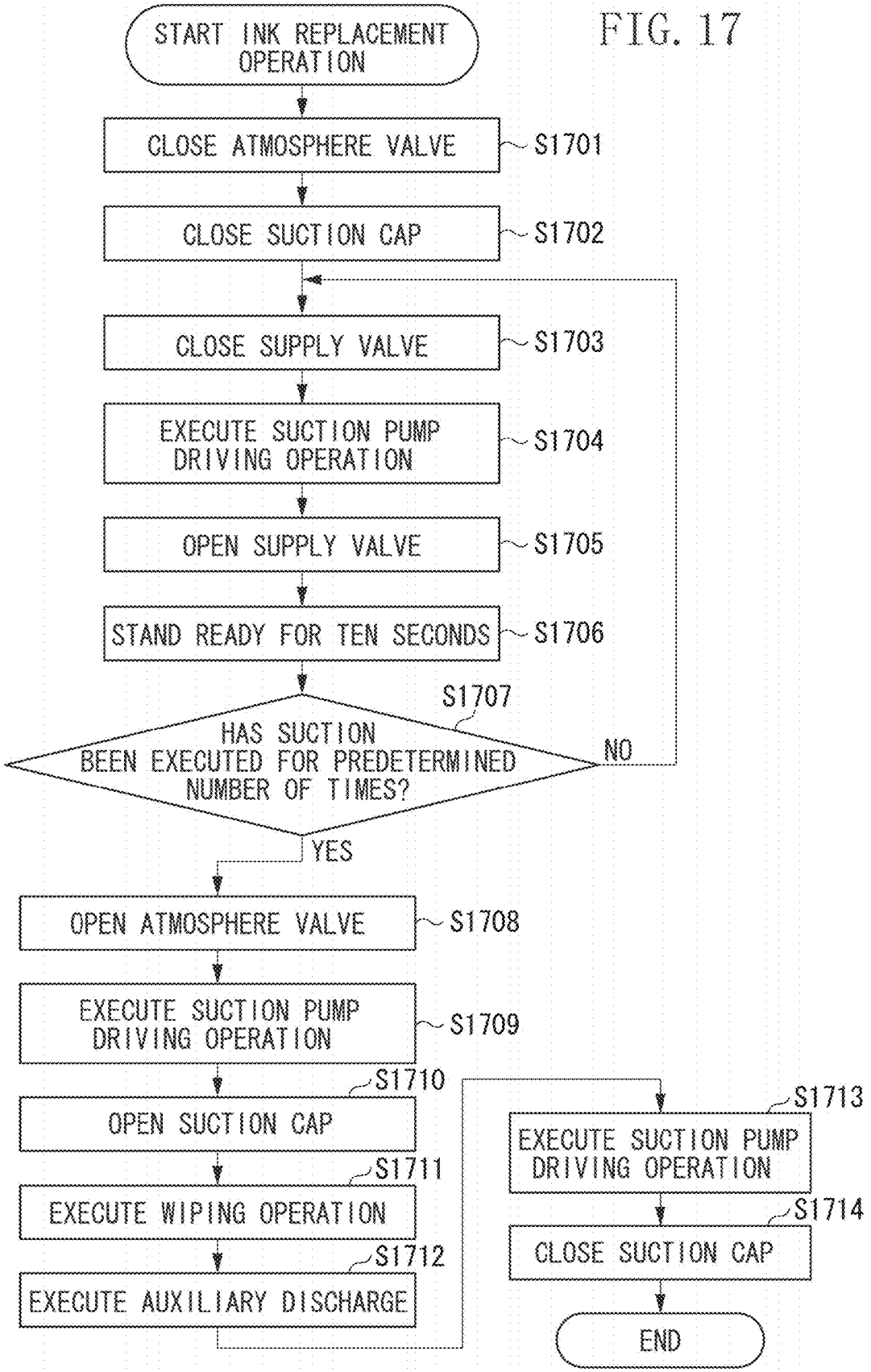
FIG. 17 is a flowchart illustrating an ink replacement operation sequence according to the sixth exemplary embodiment of the present invention.

FIG. 17 is a flowchart illustrating an ink replacement operation sequence according to the present exemplary embodiment. First, in step S1701, an atmosphere valve disposed on the suction cap 10 is closed. Then, in step S1702, discharge ports of the recording head 3 are covered by the suction cap 10 and brought into a capping state. Next, in step S1703, the supply valve 14 disposed on the supply tube 4 is closed. Then, in step S1704, the suction pump 6 is driven. Here, because the atmosphere valve is closed, the ink is sucked from the recording head 3 by driving the suction pump 6. In the present exemplary embodiment, the driving time of the suction pump 6 is set to twenty-five seconds. Then, in step S1705, the supply valve 14 disposed on the supply tube 4 is opened. In the present exemplary embodiment, ink is sucked in a state where the supply valve 14 is closed in order to increase a negative pressure within the recording head 3. Thereafter, the ink within the supply tube 4 is sucked while the supply valve 14 is opened. In step S1706, the operation is stood ready for ten seconds in order to wait until the negative pressure within the recording head 3 returns to the original state and movement of the ink within the supply tube 4 is completed. In step S1707, the number of execution times of the operations in steps S1703 to S1706 is determined. In the present exemplary embodiment, the ink of approximately 5 ml can be sucked by a series of operations executed in steps S1703 to S1706. The above ink amount of 5 ml approximately corresponds to one-region worth of volume in the supply tube 4. According to the present exemplary embodiment, ink of approximately 5 ml also exists in the recording head 3. Therefore, in the present exemplary embodiment, for example, in a case where the number of regions where the timer values have reached the predetermined time Tth is one, ink of 10 ml has to be sucked in order to discharge ink within the region (4) positioned on the side of the recording head 3. Therefore, in step S1707, it is determined whether the suction of a number of times corresponding to a number in which the number of regions where the timer values have reached the predetermined time Tth is increased by one has been executed. Then, if it is determined that the suction of that number has been executed (YES in step S1707), the processing proceeds to step S1708. In step S1708, the atmosphere valve disposed on the suction cap 10 is opened. After the atmosphere valve is opened, in step S1709, the suction pump 6 is driven for ten seconds again, and the ink within the suction cap 10 is discharged. Then, in step S1710, the suction cap 10 is opened. In step S1711, a wiping operation is executed on a face of the recording head 3. After the wiping operation, the processing proceeds to step S1712, so that auxiliary discharge is executed on the suction cap 10. In the present exemplary embodiment, auxiliary discharge of 10000 dots per nozzle is executed. Thereafter, in step S1713, the suction pump 6 is driven for ten seconds in order to discharge ink within the suction cap 10. Then, in step S1714, a face of the recording head 3 is brought into a capping state by the suction cap 10. The ink replacement operation has been described as the above. In the present exemplary embodiment, because a suction amount for each suction is substantially the same as the one-region worth of volume in the supply tube 4, the number of times of suction is changed according to the number of regions where the timer values have exceeded the predetermined time Tth.

Description will be given with reference to the flowchart of FIG. 15 again. After the ink replacement operation is ended in step S1510, the processing proceeds to step S1511. In step S1511, the timer values Tn of respective regions are updated. In step S1511, a value for updating the timer value Tn is changed according to the amount of ink replaced by the ink replacement operation. In step S1509, if the number of regions where the timer values Tn have reached the predetermined time Tth is "Q", it is determined that the regions (1) to (Q) are filled with ink newly supplied from the ink tank 9 by the ink replacement operation. Therefore, the timer values T1 to Tq corresponding to the regions (1) to (Q) are reset to 0. Further, with respect to the regions (Q+1) to (N), the timer values Tn corresponding to respective regions are updated through the following formula 9.

$$Tn=Tn-q,\ (n=Q+1 \text{ to } N) \qquad \text{Formula 9}$$

For example, if "Q" is 2, the timer value TN of the region (N) is updated to "T(N−2)" (TN=T(N−2)). In other words, the timer value of the region (N) is replaced with the timer value of the region (N−2). This indicates that the ink that has existed in the region (N−2) before the recording operation is determined to move to the region (N) because of consumption of ink caused by the recording operation, and thus the timer value is updated according to the movement thereof. Similarly, timer values Tn of the regions (Q+1) to (N) are updated through the above formula 9. As described above, the timer values Tn of all of the regions (1) to (N) are updated. Then, the update sequence of the value T is ended. After the timer values Tn are updated, the processing proceeds to step S1503. Processing of step S1503 and subsequent steps has already been described, and thus description thereof will be omitted.

As described above, according to the present invention, if the ink is consumed by the recording operation before the elapsed time from the previous discharge operation (replacement operation) has become equal to or greater than the predetermined time, a timing for executing the subsequent discharge operation can be postponed based on the ink consumption amount after the previous discharge operation. Then, an increase of waste ink caused by the discharge operation can be suppressed by making a time interval between the previous discharge operation and the subsequent discharge operation longer.

In other words, according to the present invention, it is possible to provide an ink jet recording apparatus capable of suppressing an increase of waste ink while solving an increase in density of ink within the supply tube.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-057752, filed Mar. 20, 2015, which is hereby incorporated by reference herein in its entirety.

What is claimed is:

1. An ink jet recording apparatus comprising:

a recording head configured to discharge ink;

a tank configured to store ink to be supplied to the recording head;

a supply tube configured to supply ink to the recording head from the tank;

a discharge unit configured to execute a discharge operation for discharging ink within the supply tube;

a control unit configured to make the discharge unit execute a discharge operation when an elapsed time from a previous discharge operation is greater than a predetermined time; and a changing unit configured to change at least any one of the elapsed time or the predetermined time based on an ink consumption amount consumed through the recording head after the previous discharge operation.

2. The ink jet recording apparatus according to claim 1, wherein, in a case where the ink consumption amount is greater than a threshold value, the changing unit changes a value of the elapsed time to be smaller than in a case where the ink consumption amount is less than the threshold value.

3. The ink jet recording apparatus according to claim 1, wherein, in a case where the ink consumption amount is greater than a threshold value, the changing unit changes a value of the predetermined time to be greater than in a case where the ink consumption amount is less than the threshold value.

4. The ink jet recording apparatus according to claim 1, wherein the discharge unit executes a discharge operation for discharging ink of an amount greater than a volume of the supply tube.

5. The ink jet recording apparatus according to claim 1, wherein the ink consumption amount includes an amount of ink consumed through the recording head by a recording operation in which the recording head records an image on a recording medium.

6. The ink let recording apparatus according to claim 1, wherein the ink consumption amount includes an amount of ink consumed through the recording head by a recovery operation in which the recording head discharges ink in order to recover the recording head.

7. The ink jet recording apparatus according to claim 1, further comprising:

a measurement unit configured to measure an elapsed time from a previous discharge operation; and a storage unit configured to store a plurality of the elapsed times measured by the measurement unit, wherein the changing unit changes the plurality of the elapsed times based on an ink consumption amount consumed through the recording head after a previous discharge operation.

8. The ink jet recording apparatus according to claim 7, wherein, with regard to the plurality of the elapsed times, a number of elapsed times values of which are changed is greater, in a case where the ink consumption amount is greater than a threshold value, than in a case where the ink consumption amount is less than the threshold value.

9. The ink jet recording apparatus according to claim 7, wherein, in a case where the ink consumption amount is greater than a threshold value, the changing unit changes a value of the elapsed time to be smaller than in a case where the ink consumption amount is less than the threshold value.

10. The ink jet recording apparatus according to claim 7, wherein, with regard to the plurality of the elapsed times, in a case where a number of the elapsed times greater than a predetermined time is greater than a predetermined number, the control unit controls an amount of ink that is to be discharged by the discharge unit to be greater than in a case where the number of the elapsed times greater than the predetermined time is less than the predetermined number.

11. The ink jet recording apparatus according to claim 1 further comprising a valve capable of switching a state between a first state in which ink can be supplied to the recording head from the tank and a second state in which ink cannot be supplied to the recording head from the tank, wherein the valve switches the state to the second state when the discharge operation is to be executed, and switches the state to the first state after the discharge operation is executed.

12. The ink jet recording apparatus according to claim 1 further comprising a suction cap contacting the recording head, configured to suck ink from the recording head, wherein the discharge operation includes a suction operation in which ink is sucked by the suction cap.

* * * * *